US008204417B2

(12) United States Patent
Barton

(10) Patent No.: US 8,204,417 B2
(45) Date of Patent: Jun. 19, 2012

(54) APPARATUSES USEFUL IN PRINTING, FIXING DEVICES AND METHODS OF STRIPPING MEDIA FROM SURFACES IN APPARATUSES USEFUL IN PRINTING

(75) Inventor: Augusto E. Barton, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 435 days.

(21) Appl. No.: 12/512,272

(22) Filed: Jul. 30, 2009

(65) Prior Publication Data

US 2011/0026985 A1 Feb. 3, 2011

(51) Int. Cl.
*G03G 15/20* (2006.01)

(52) U.S. Cl. ..... 399/323

(58) Field of Classification Search ..... 399/323, 399/322, 398, 22, 406, 329
See application file for complete search history.

(56) References Cited

U.S. PATENT DOCUMENTS

| | | | | |
|---|---|---|---|---|
| 6,564,033 | B2 | 5/2003 | Zhou et al. | |
| 7,228,082 | B1 | 6/2007 | Davidson et al. | |
| 2003/0228179 | A1 | 12/2003 | Yaomin et al. | |
| 2005/0006370 | A1 | 1/2005 | Suzumi | |
| 2005/0036809 | A1 | 2/2005 | Fukita et al. | |
| 2005/0220507 | A1 * | 10/2005 | Uehara et al. | 399/329 |
| 2006/0210331 | A1 | 9/2006 | Baba et al. | |
| 2007/0048035 | A1 | 3/2007 | Baba et al. | |
| 2007/0048042 | A1 | 3/2007 | Uehara et al. | |
| 2007/0092277 | A1 | 4/2007 | Miyata et al. | |
| 2007/0166084 | A1 | 7/2007 | Yoshino et al. | |
| 2007/0172272 | A1 * | 7/2007 | Miyata et al. | 399/329 |
| 2008/0037069 | A1 | 2/2008 | Mestha et al. | |

FOREIGN PATENT DOCUMENTS

| | | | |
|---|---|---|---|
| JP | 09134090 A | * | 5/1997 |
| JP | 2002287556 | | 10/2002 |
| JP | 2003095504 | | 4/2003 |
| JP | 2007199115 | | 8/2007 |

OTHER PUBLICATIONS

Anthony S. Condello et al; "Apparatuses Useful in Printing and Methods of Fixing Marking Material on Media"; U.S. Appl. No. 12/490,601, filed Jun. 24, 2009.
Christine A. Keenan; "Apparatuses Useful for Printing and Methods of Stripping Media From Surfaces in Apparatuses Useful for Printing"; U.S. Appl. No. 12/352,250, filed Jan. 12, 2009.
EP Search Report Issued Dec. 2, 2010, in Related European Application No. EP10171101.8.

* cited by examiner

*Primary Examiner* — David Gray
*Assistant Examiner* — Billy J Lactaoen
(74) *Attorney, Agent, or Firm* — Ronald E. Prass, Jr.; Prass LLP

(57) ABSTRACT

Apparatuses useful in printing, fixing devices and methods of stripping media from surfaces in apparatuses useful in printing are provided. An exemplary embodiment of an apparatus useful in printing includes a first member including a first surface; a second member including a second surface; a belt including an inner surface contacting the second surface and an outer surface contacting the first surface to form a nip through which the belt rotates; and a tensioned stripping wire contacting the inner surface of the belt and spaced from the second surface. The stripping wire can produce a sufficiently-high stripping force to facilitate stripping of media passed through the nip from the outer surface of the belt.

18 Claims, 6 Drawing Sheets

APPARATUSES USEFUL IN PRINTING, FIXING DEVICES AND METHODS OF STRIPPING MEDIA FROM SURFACES IN APPARATUSES USEFUL IN PRINTING

BACKGROUND

In some printing apparatuses, images are formed on media using a marking material. Such printing apparatuses can include a belt that defines a nip. Media are fed to the nip and subjected to processing conditions to fix the marking material onto the media.

It would be desirable to provide apparatuses useful for printing and associated methods that can strip media from surfaces effectively.

SUMMARY

Apparatuses useful in printing, fixing devices and methods of stripping media from surfaces in apparatuses useful in printing are provided. An exemplary embodiment of the apparatuses useful in printing comprises a first member including a first surface; a second member including a second surface; a belt including an inner surface contacting the second surface and an outer surface contacting the first surface to form a nip through which the belt rotates; and a tensioned stripping wire contacting the inner surface of the belt and spaced from the second surface. The stripping wire produces a sufficiently-high stripping force to facilitate stripping of media passed through the nip from the outer surface of the belt.

DRAWINGS

DETAILED DESCRIPTION

The disclosed embodiments include an apparatus useful in printing. The apparatus comprises a rotatable first member including a first surface; a support member including a second surface; a belt including an inner surface contacting the second surface and an outer surface contacting the first surface to form a nip through which the belt rotates; and a tensioned stripping wire contacting the inner surface of the belt and spaced from the second surface. The stripping wire produces a sufficiently-high stripping force to facilitate stripping of media passed through the nip from the outer surface of the belt.

The disclosed embodiments further include a fixing device for fixing marking material on media. The fixing device comprises a first member including a first surface; a support member including a second surface; a belt including an inner surface contacting the second surface and an outer surface contacting the first surface to form a nip through which the belt rotates; and a tensioned stripping wire contacting the inner surface of the belt and spaced from the second surface. The stripping wire produces a sufficiently-high stripping force to facilitate stripping of media passed through the nip from the outer surface of the belt.

The disclosed embodiments further include a method of stripping media from a surface in an apparatus useful in printing. The method comprises feeding a medium having marking material thereon to a nip, the nip being formed by a first surface of a first member and an outer surface of a belt rotatably supported on a second surface of a second member, the medium contacting the first surface and the outer surface of the belt at the nip; contacting the inner surface of the belt with a tensioned stripping wire located between the second surface and the inner surface and spaced from the second surface; and stripping the medium from the outer surface of the belt after the medium passes through the nip. The stripping wire produces a sufficiently-high stripping force to facilitate the stripping of the medium from the outer surface of the belt.

As used herein, the term "printing apparatus" encompasses apparatuses that can use various types of solid and liquid marking materials, including toners and inks (e.g., liquid inks, gel inks, heat-curable inks and radiation-curable inks), and the like. The apparatuses can use various thermal, pressure and other process conditions to treat marking materials on media.

Figure 1:
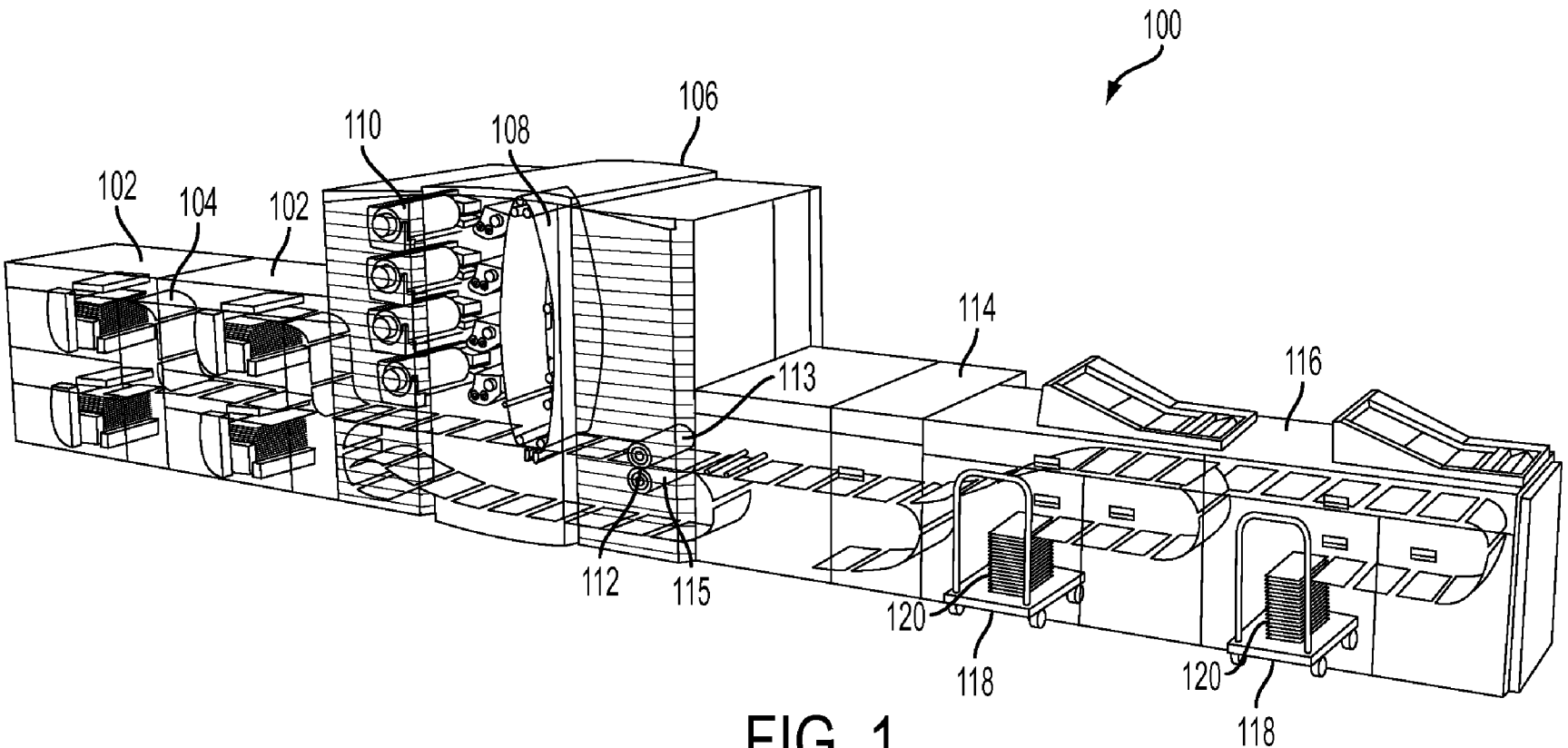
FIG. 1 depicts an exemplary embodiment of a printing apparatus.

FIG. 1 illustrates an exemplary printing apparatus 100 disclosed in U.S. Patent Application Publication No. 2008/0037069, which is incorporated herein by reference in its entirety. The printing apparatus 100 includes two media feeder modules 102 arranged in series, a printer module 106 adjacent the media feeder modules 102, an inverter module 114 adjacent the printer module 106, and two stacker modules 116 arranged in series adjacent the inverter module 114. In the printing apparatus 100, the media feeder modules 102 feed media to the printer module 106. In the printer module 106, toner is transferred from a series of developer stations 110 to a charged photoreceptor belt 108 to form toner images on the photoreceptor belt 108 and produce prints. The toner images are transferred to respective media 104 fed through the paper path. The media are advanced through a fuser 112 including a fuser roll 113 and a pressure roll 115, which form a nip where heat and pressure are applied to the media to fuse toner images onto the media. The inverter module 114 manipulates media exiting the printer module 106 by either passing the media through to the stacker modules 116, or inverting and returning the media to the printer module 106. In the stacker modules 116, the printed media are loaded onto stacker carts 118 to form stacks 120.

Apparatuses useful in printing, fixing devices and methods of stripping media in apparatuses useful in printing are provided. The apparatuses are constructed to allow different types of marking material to be treated on different types of media. The apparatuses include a belt. The belt can be heated to supply thermal energy to media contacting the belt. The apparatuses are constructed to allow different types of media to be stripped from the belt.

Figure 2:
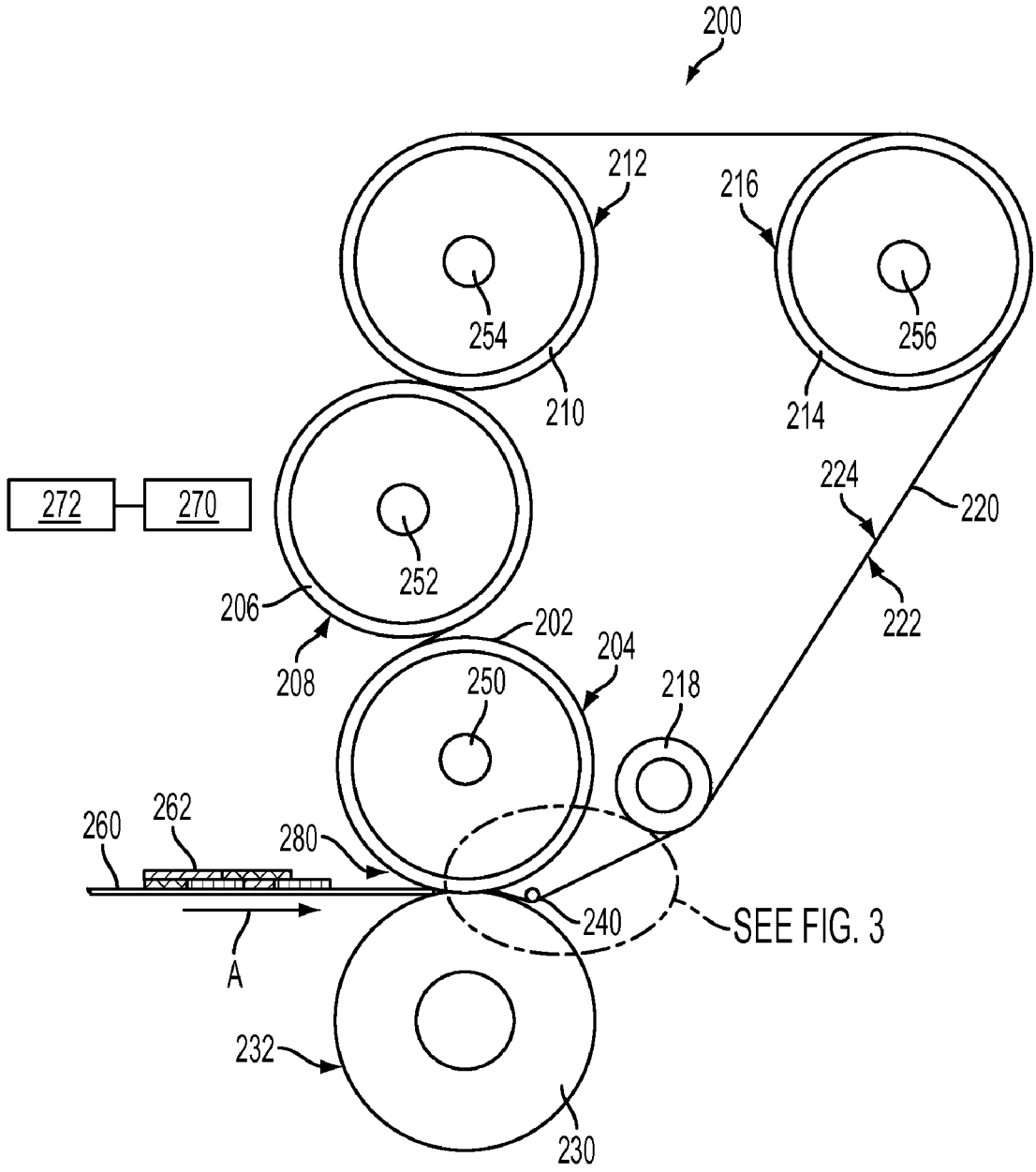
FIG. 2 depicts an exemplary embodiment of a fixing device including a tensioned stripping wire.

Embodiments of the apparatuses useful in printing can include a fixing device. FIG. 2 illustrates an exemplary embodiment of a fuser 200 constructed to fix marking materials onto media. Embodiments of the fuser 200 can be used in different types of printing apparatuses. For example, the fuser 200 can be used in place of the fuser 112 in the printing apparatus 100 shown in FIG. 1.

As shown in FIG. 2, the fuser 200 includes a continuous belt 220 provided on a fuser roll 202, an external roll 206, internal rolls 210, 214 and an idler roll 218. The belt 220 has an outer surface 222 and an inner surface 224.

The fuser roll 202, external roll 206 and internal rolls 210, 214 have outer surfaces 204, 208, 212 and 216, respectively, contacting the belt 220. The fuser roll 202, external roll 206 and internal rolls 210, 214 include internal heating elements 250, 252, 254 and 256, respectively. The heating elements 250, 252, 254 and 256 can be, e.g., one or more axially-extending lamps. The heating elements are connected to a power supply 270 in a conventional manner. The power supply 270 is connected to a controller 272 in a conventional manner. The controller 272 controls the supply of voltage to the heating elements 250, 252, 254 and 256, to heat the belt 220 to the desired temperature.

The fuser 200 further includes an external pressure roll 230 having an outer surface 232. The outer surface 232 is shown engaging the outer surface 222 of the belt 220. The outer surface 232 of the pressure roll 230 and the outer surface 222 of the belt 220 together form a nip 280. The pressure roll 230 can include a core, an inner layer overlying the core, and an outer layer overlying the inner layer and forming the outer surface 232. The core can be comprised of aluminum, steel or the like, the inner layer of an elastomeric material, such as silicone rubber, or the like, and the outer layer of a low-friction polymer, such as polytetrafluoroethylene (Teflon®), or the like.

Embodiments of the belt 220 can include two or more layers. For example, the belt 220 can include a base layer, an intermediate layer on the base layer, and an outer layer on the intermediate layer. In such embodiments, the base layer forms the inner surface 224 and the outer layer forms the outer surface 222 of the belt 220. In an exemplary embodiment, the base layer can be comprised of a polymer, such as polyimide, or the like; the intermediate layer of silicone, or the like; and the outer layer of a polymer, such as a fluoroelastomer sold under the trademark Viton® by DuPont Performance Elastomers, L.L.C., polytetrafluoroethylene, or the like.

In embodiments, the belt 220 can have a thickness of about 0.1 mm to about 0.5 mm, such as less than about 0.2 mm. For example, the belt 220 can include a base layer having a thickness of about 50 μm to about 100 μm, an intermediate layer having a thickness of about 100 μm to about 500 μm, and an outer layer having a thickness of about 20 μm to about 40 μm. The belt 220 can typically have a width dimension along the longitudinal axis of the fuser roll 202 of about 350 mm to about 450 mm.

FIG. 2 depicts a medium 260 being fed to the nip 280 in the process direction A. The fuser roll 202 is rotated counter-clockwise and the pressure roll 230 is rotated clockwise to rotate the belt 220 counter-clockwise and convey the medium 260 through the nip 280. The medium 260 can be, e.g., a coated or uncoated paper sheet. Light-weight paper typically has a weight of ≦ about 75 gsm, medium-weight paper a weight of about 75 gsm to about 160 gsm, and heavy-weight paper a weight of ≧160 gsm.

The outer surface 232 of the pressure roll 230 is deformed by contact with the belt 220 on the fuser roll 202. The outer surface 204 of the fuser roll 202 may also be deformed by this contact depending on its composition.

As shown in FIG. 2, the fuser 200 further includes a stripping wire 240. The stripping wire 240 is located internally to the belt 220, i.e., on the side of the inner surface 224. The stripping wire 240 facilitates stripping of media from the outer surface 222 of the belt 220. Media used in the fuser 200 may range in weight from light-weight to heavy-weight, and can be coated or uncoated.

Figure 3:
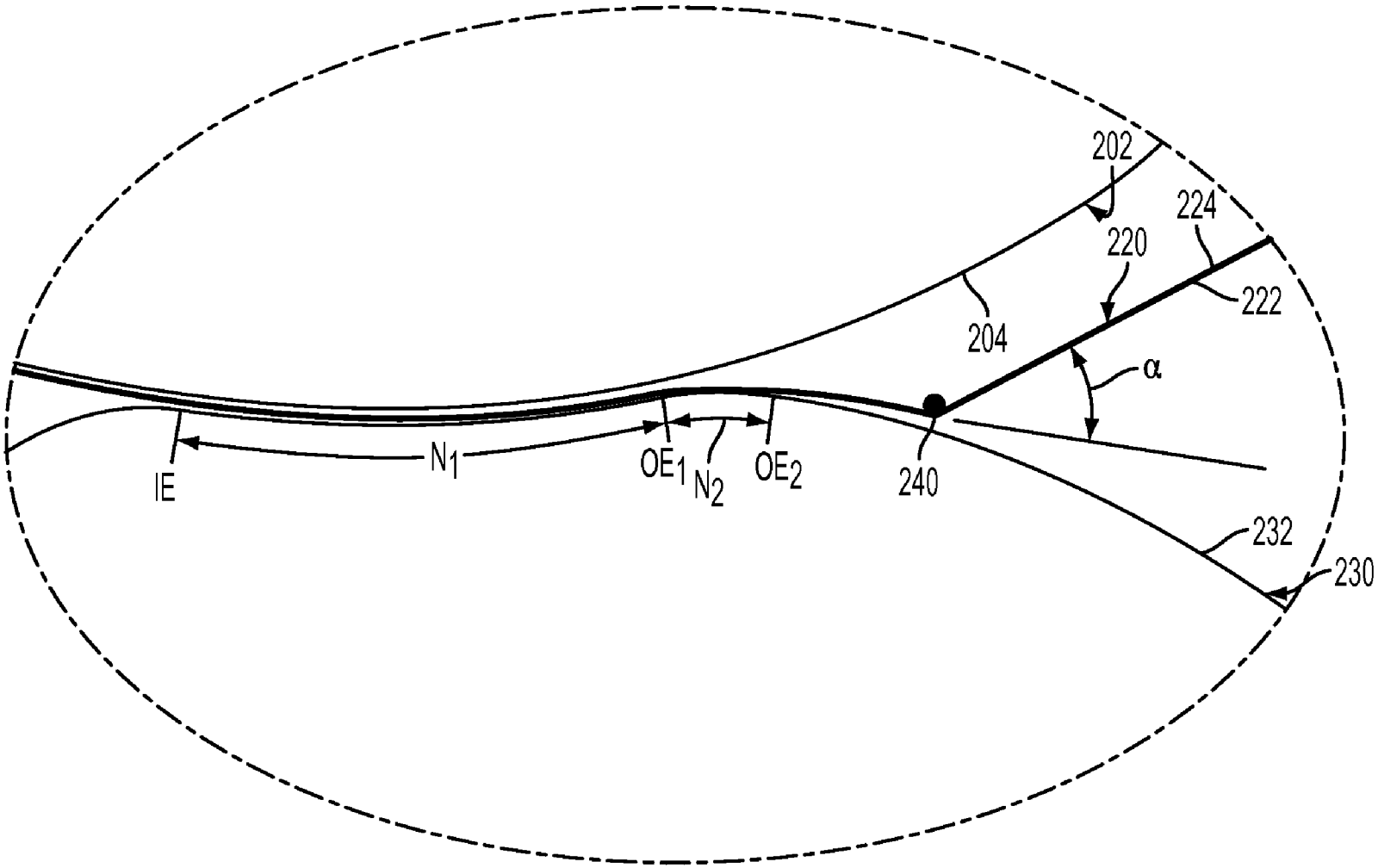
FIG. 3 is an enlarged view of the nip region of the fixing device shown in FIG. 2.

FIG. 3 is an enlarged view depicting a portion of the fuser 200 including the fuser roll 202, pressure roll 230, belt 220 and stripping wire 240. The belt 220 is located between the outer surface 204 of the fuser roll 202 and the outer surface 232 of the pressure roll 230. As shown, the nip 280 (FIG. 2) includes a first nip $N_1$ that extends between an inlet end, IE, and an outlet end $OE_1$ downstream from the inlet end IE. Media are fed to the inlet end IE and exit at the outlet end $OE_1$. At the first nip $N_1$, the belt 220 contacts the outer surface 204 of the fuser roll 202 and the outer surface 232 of the pressure roll 230. The belt 220 diverges from the outer surface 204 of the fuser roll 202 at the outlet end $OE_1$ of the first nip $N_1$. The first nip $N_1$ is a high-pressure region at which thermal energy and pressure are applied to treat marking material on media. For example, toner can be fused on media by heating the media to at least the toner fusing temperature at the first nip $N_1$.

As shown in FIG. 3, the nip 280 (FIG. 2) further includes a second nip, $N_2$, adjacent the first nip $N_1$. The second nip $N_2$ extends from about the outlet end $OE_1$ of the first nip $N_1$ to an outlet end $OE_2$, which is downstream from the outlet end $OE_1$. The belt 220 diverges from the outer surface 232 of the pressure roll 230 at the outlet end $OE_2$. The stripping wire 240 is located downstream from the outlet end $OE_2$ of the second nip $N_2$. Media are stripped from the outer surface 222 of the belt 220 adjacent to the stripping wire 240. The stripping wire 240 is located sufficiently close to the outlet end $OE_1$ of the first nip $N_1$ to allow media to be stripped from the belt 220 immediately after exiting the first nip $N_1$.

At the location of the stripping wire 240, the fuser belt 220 bends at a stripping angle, α, further away from the outer surface 232 of pressure roll 230. The stripping angle α can typically be from about 15° to about 90°.

In the fuser 200, the stripping wire 240 is subjected to a side load from tension in the belt 220. The side load acts in a direction toward the fuser roll 202. The stripping wire 240 is tensioned to limit the magnitude of the deflection (or sag) of the stripping wire 240 resulting from the stripping wire 240 being subjected to the side load from the belt 220. The deflection of the stripping wire 240 can be limited to no more than a desired value by this tensioning. By limiting deflection of the stripping wire 240, the stripping wire 240 and belt 220 are kept from contacting the fuser roll 202 (and un-forming the second nip $N_2$), such as shown in FIG. 3.

The magnitude of deflection at the center of the wire, D, in the stripping wire 240 is given by the equation:

$$D=WL^2/8T. \quad (1)$$

In equation (1), W is the side load applied to the stripping wire 240 from the belt 220, L is the length of the stripping wire 240, and T is the tension in the stripping wire 240. As shown in equation (1), as T increases, D decreases. In embodiments, the deflection D can be limited to less than about 5 mm, such as less than about 2 mm, to keep the belt 220 away from the fuser roll 202. It is also desirable to maintain the stripping wire 240 at a substantially-constant distance from the outer surface 204 of the fuser roll 202, along the entire portion of the stripping wire 240 that contacts the belt 220, to maintain a substantially-constant stripping angle α and produce a substantially-uniform stripping force along the entire width of the belt 220.

In embodiments, the stripping wire 240 is tensioned to limit its deflection to less than the desired maximum deflection without exceeding the yield point of the material of the stripping wire 240. At the yield point, materials begin to plastically deform. The tensile stress $\sigma$ in the stripping wire 240 is kept below the yield stress, $\sigma_Y$, of the material it is comprised of in order to avoid plastic deformation.

In the elastic region, the tensile stress, $\sigma$, in the stripping wire 240 is given by:

$$\sigma=E\cdot\epsilon. \quad (2)$$

In equation (2), E is the Young's modulus of the material of the stripping wire 240, and $\epsilon$ is the strain in the stripping wire 240. The strain $\epsilon$ is given by:

$$\epsilon=\Delta L/L. \quad (3)$$

In equation (3), L is the original length of the stripping wire 240, and $\Delta L$ is change in length of the stripping wire 240 produced by the tensile stress. Combining equations (2) and (3) gives:

$$\sigma=E\cdot\Delta L/L. \quad (4)$$

In embodiments, the stripping wire 240 can comprise any suitable material that can be tensioned to at least the desired tensile stress level to limit deflection to less than the desired maximum value, without exceeding the elastic limit of the material. For example, the material can be a metallic alloy, such as a stainless steel, or the like. A suitable material for the stripping wire is Sandvik Nanoflex® stainless steel wire available from Sandvik AB of Sandviken, Sweden. These wires are available in round form in the cold worked condition with a tensile strength (at 20° C.) of 950 MPa to 2150 MPa, and in the aged condition with a tensile strength of 1400 MPa to 3000 MPa.

The stripping wire 240 can be coated with a low-friction material to reduce wear of the inner surface 224 of the belt 220 caused by contact with the stripping wire 240 during rotation of the belt 220. The low-friction material can be, e.g., TEFLON®, or the like.

In embodiments, the stripping wire 240 has a length exceeding the width of the belt 220. For example, the stripping wire 240 can have a length of about 400 mm to about 500 mm.

The diameter of the stripping wire 240 can be selected to produce a sufficiently-high stripping force for stripping media most commonly used in the fuser 200. Decreasing the diameter of the stripping wire 240 increases the stripping force. Thin media carrying a high toner mass are typically the most difficult media to strip from the belt. Consequently, the highest stripping force (smallest-diameter stripping wire) can be used to strip such light-weight media. Heavy-weight media with a low toner mass are typically easiest to strip. Consequently, the lowest stripping force (largest-diameter stripping wire) can be used to strip such heavy-weight media. To reduce wear of the belt 220, media can be stripped from the belt 220 using an embodiment of the stripping wire 240 with the largest diameter that produces a sufficiently-high stripping force to strip the media.

The tension in the stripping wire 240 can be set at cold temperature (e.g., ambient temperature) so that when the fuser 200 warms up to a desired elevated temperature (e.g., the operating temperature), the stripping wire 240 will have sufficient tension so that the load of the belt 220 will cause the stripping wire 240 to deflect by no more than the maximum desired amount, e.g., 2 mm.

When a tensioned wire is heated, its length L increases:

$$\Delta L=L\cdot\alpha\cdot\Delta\text{Temp}. \quad (5)$$

In equation (5), $\alpha$ is the coefficient of thermal expansion of the wire material. This thermal expansion reduces the tensile stress in the wire by an amount, $\Delta\sigma$. Combining equations (4) and (5) gives:

$$\Delta\sigma=E\cdot\alpha\cdot\Delta\text{Temp}. \quad (6)$$

This decrease in the wire stress produces a decrease in tension, $\Delta T$:

$$\Delta T=E\cdot\alpha\cdot\Delta\text{Temp}\cdot A. \quad (7)$$

In equation (7), A is the cross-sectional area of the wire.

Equation (7) shows that for a given wire material and operating temperature, the decrease in tension $\Delta T$ in the wire resulting from heating the wire is controlled by the wire cross-sectional area A. As the wire diameter decreases, the decrease in tension in the wire resulting from the temperature change decreases.

Figure 4:
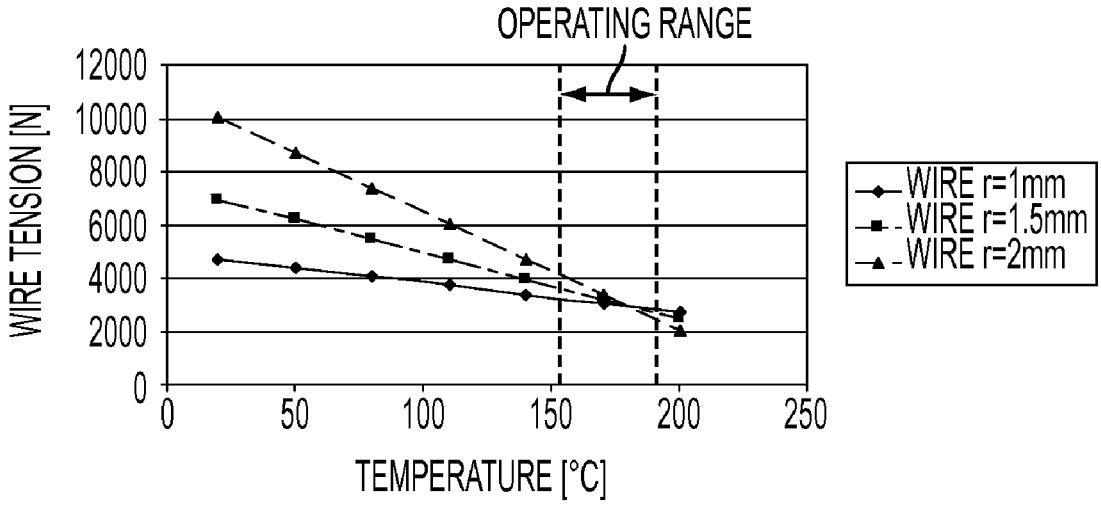
FIG. 4 shows curves illustrating the relationship between wire tension and wire temperature for wires having a radius of 1 mm, 1.5 mm and 2 mm.

In embodiments, in order to limit the deflection in the stripping wire 240 to no more than a desired maximum value when the wire is at the operating temperature of the fuser 200, a sufficiently-high wire tension is needed at the operating temperature. FIG. 4 shows modeled curves depicting the relationship between wire tension and wire temperature for wires having a radius of 1 mm ("◇"), 1.5 mm ("□") and 2 mm ("Δ"), and a typical temperature operating range of the fuser 200. These curves show that the wire tension increases when temperature decreases, and that the thinnest wires have the lowest change in tension as a result of the temperature change.

Figure 5:
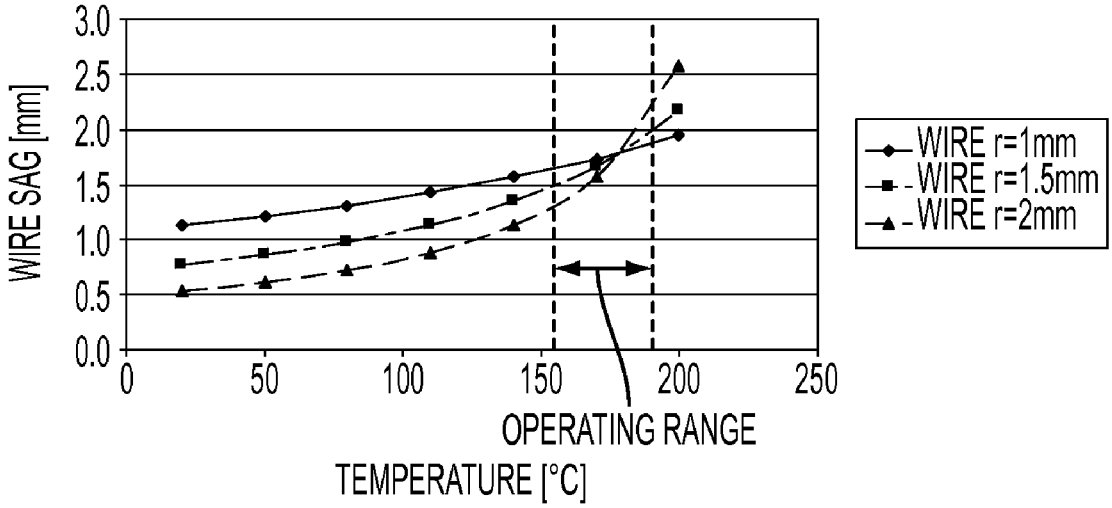
FIG. 5 shows curves illustrating the relationship between wire sag and wire temperature for wires having a radius of 1 mm, 1.5 mm and 2 mm.

FIG. 5 shows curves depicting the relationship between wire sag and wire temperature for the same wires as in FIG. 4 having a radius of 1 mm, 1.5 mm and 2 mm. Each of these wires has a length of 460 mm and is subjected to a belt tension load of 92 N (0.2 N/mm). As demonstrated in FIG. 5, the thickest wires experience the highest sag at the high-end of the operating range. Consequently, the thickest wires need to be subjected to the highest tension when cold (as shown in FIG. 4) to limit sag of these wires to no more than the maximum desired value when the wires are at the operating temperature.

In embodiments, a small-diameter stripping wire 240 (e.g., radius=1 mm) can be used with a smaller support structure than thick wires because a lower tension can be applied to the small-diameter wire when cold to achieve the desired limited deflection when heated to the operating temperature. A small wire radius also provides a sufficiently-high stripping force to strip light-weight media, as well as other media types.

Figure 6:
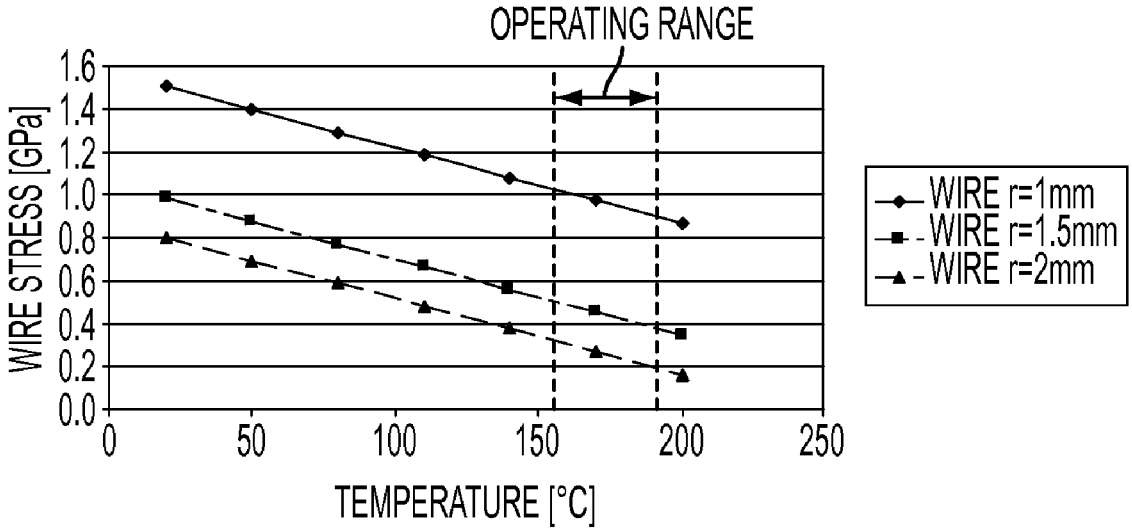
FIG. 6 shows curves illustrating the relationship between wire stress and wire temperature for wires having a radius of 1 mm, 1.5 mm and 2 mm.

FIG. 6 depicts curves for the same wires as in FIG. 4 having a radius of 1 mm, 1.5 mm and 2 mm. The curves in FIG. 6 demonstrate that the smaller the wire radius, the higher the stress over the entire temperature range. The curves also demonstrate that the wire having a radius of 1 mm has a significantly-higher stress than thicker wires having radii of 1.5 mm and 2 mm.

FIG. 6 shows that the wire having a radius of 1 mm is subjected to a tensile stress of about 1.5 GPa when at a temperature of about 20° C. (i.e., cold). In embodiments, the stripping wire can have a tensile strength that provides a safety factor. For example, the stripping wire can have a tensile strength of about 2.0 GPa to provide an acceptable safety factor of about 1.3.

Figure 7:
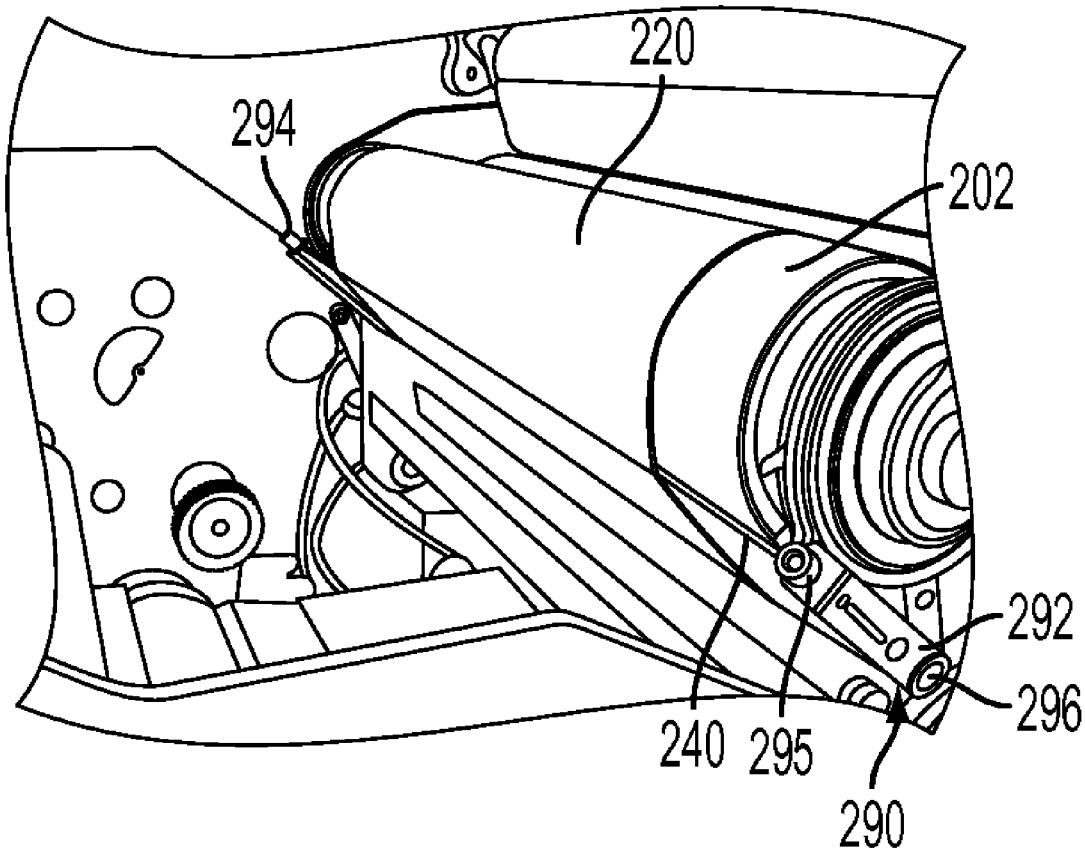
FIG. 7 depicts a portion of an exemplary fixing device including a tensioned stripping wire and tensioning device for adjusting tension in the stripping wire.

In embodiments, the stripping wire 240 is secured to a tensioning device for adjusting the tension in the stripping wire 240. Typically, the tension is adjusted when the stripping wire 240 is cold. FIG. 7 shows a stripping wire 240 secured to an exemplary tensioning device 290, and a belt 220 supported on a fuser roll 202. The belt 220 applies a load to the stripping wire 240. The tensioning device 290 includes a first element 292 secured to the stripping wire 240 at, or proximate to, one end of the stripping wire 240 outward from one edge of the belt 220 (e.g., the outboard edge), and a second element 294 secured to the stripping wire 240 at, or proximate to, the opposite end of the stripping wire 240 outward from the opposite edge of the belt 220 (i.e., the inboard edge). The first element 292 and second element 294 can have the same structure and, for simplicity, only the first element 292 will be described in detail.

The illustrated first element 292 includes a wire locking element 295, which is rotatable to fix the stripping wire 240 inside the first element 292 and prevent movement of the stripping wire 240 relative to the first element 292. The first element 292 also includes a tensioning element 296, which is rotatable in a first direction to move (tilt) the first element 292 in a direction relative to fuser roll 202 to increase tension in the stripping wire 240, and in an opposite, second direction relative to fuser roll 202 to tilt the first element 292 in another direction to decrease tension in the stripping wire 240.

In other embodiments, the tensioning device for tensioning the stripping wire 240 can comprise a compliant element (not shown) secured to at least one end of the tensioning elements for the stripping wire 240. The compliant element can provide a spring force effective to tension the stripping wire 240 to limit its deflection during operation of the fuser 200. The compliant element can limit the increase in tension of the stripping wire 240 at ambient temperature, thereby allowing the overall stress in the stripping wire 240 to be reduced.

In other embodiments, the stripping wire 240 can be tensioned based on tolerances to set the length of the stripping wire 240 before it is mounted in the fuser 200. For example, the stripping wire 240 can have a pre-set length so that when the stripping wire 240 is secured to support elements for the stripping wire 240, and these support elements are mounted in the fuser 200, the stripping wire 240 will be stretched (i.e., strained) to produce the desired tension in the stripping wire 240. For example, a wire having a radius of 1 mm can have a pre-set length that is about 3.4 mm shorter before mounting in the fuser in order for the wire to have a tension of about 4700 N when in a cold condition, and a tension of about 2950 N at a typical elevated operating temperature. In embodiments, the tension in the stripping wire is sufficient to limit its deflection toward the fuser roll to less than the maximum desired value. Such loading of the stripping wire can be produced by embodiments of the tensioning device 290.

In embodiments, the stripping wire can provide a simple structure for stripping different types of media from belts in fixing devices. The stripping wire is small, allowing it to be positioned in fusers, as well as in other fixing devices, to avoid interfering with members, such as the fuser roll, or with the belt path.

Embodiments of the stripping wires can be used in fixing devices, such as fusers, having a different construction than the fuser 200 shown in FIG. 2. For example, the stripping wires can be used in fixing devices that include a drive roll, such as a pressure roll, and a continuous belt supported on a support structure. The support structure can be stationary in the fixing device. The belt can be free-spinning about the support structure and caused to rotate by engagement with the rotating drive roll. The drive roll and belt form a nip through which the belt is rotated. A heater can be located internal to the belt for heating the belt. In such fixing devices, the stripping wire can be located internal to the belt to strip media from the outer surface of the belt after the media have been heated to treat marking material on the media at the nip. Exemplary fixing devices including a stripping member for stripping media from a belt, such as the stripping wire 240, in which the stripping wires can be used in place of the stripping member, are disclosed in U.S. patent application Ser. No. 12/490,601, filed Jun. 24, 2009, which is incorporated herein by reference in its entirety.

Embodiments of the stripping wires can also be used in apparatuses useful in printing to assist stripping of media from belts that have different structures and functions than fuser belts. For example, the stripping members can be used in printing apparatuses to assist stripping of media from photoreceptor belts used to transfer images to media, and in printing apparatuses to assist stripping of media from intermediate belts used to transport images that are transferred to media. Apparatuses useful for printing can include more than one stripping member for stripping media from more than one belt included in such apparatuses.

It will be understood that the teachings and claims herein can be applied to any treatment of marking material on a medium. For example, the marking material can be toner, liquid or gel ink, and/or heat- or radiation-curable ink; and/or the medium can utilize certain process conditions, such as temperature, for successful printing. The process conditions, such as heat, pressure and other conditions that are desired for the treatment of ink on media in a given embodiment may be different from the conditions that are suitable for fusing.

It will be appreciated that various ones of the above-disclosed, as well as other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. An apparatus useful in printing, comprising:
- a first member including a first surface;
- a second member including a second surface;
- a belt including an inner surface contacting the second surface and an outer surface contacting the first surface to form a nip through which the belt is rotated;
- a tensioned stripping wire contacting the inner surface of the belt and spaced from the second surface, the stripping wire producing a sufficiently-high stripping force to facilitate stripping of media passed through the nip from the outer surface of the belt;
- a tensioning device secured to the stripping wire, the tensioning device providing adjustment of the tension in the stripping wire to limit deflection of the stripping wire toward the second surface of the second member and maintain a portion of the belt spaced from the second surface, wherein the tensioning device comprises a first element secured to the stripping wire at a first location outward from a first edge of the belt, and a second member secured to the stripping wire at a second location outward from a second edge of the belt opposite to the first edge, at least one of the first element and second element being movable relative to the support member to adjust the tension in the stripping wire.

2. The apparatus of claim 1, wherein the stripping wire has a diameter of less than about 2 mm.

3. The apparatus of claim 2, wherein the stripping wire has a diameter of less than about 1 mm.

4. The apparatus of claim 1, wherein:
- the belt is continuous and comprises a polymer forming the inner surface; and
- the stripping wire comprises a coating of a low-friction material effective to reduce wear of the inner surface of the belt during rotation of the belt.

5. A fixing device for fixing marking material on media, comprising:

a first roll including a first surface;

a support member including a second surface;

a belt including an inner surface contacting the second surface and an outer surface contacting the first surface to form a nip through which the belt rotates; and a tensioned stripping wire contacting the inner surface of the belt and spaced from the second surface, the stripping wire producing a sufficiently-high stripping force to facilitate stripping of media passed through the nip from the outer surface of the belt, wherein the nip comprises:

a first nip formed by contact between (i) the inner surface of the belt and the second surface of the support member and (ii) the outer surface of the belt and the first surface of the first roll, the first nip extends from an inlet end where media enter the first nip to a first outlet end downstream from the inlet end where the media exit the first nip, the belt diverges from the second surface at the first outlet end; and a second nip formed by the outer surface of the belt contacting the first surface, the second nip extends from about the first outlet end of the first nip to a second outlet end downstream from the first outlet end;

wherein the inner surface of the belt is spaced from the second surface at the second nip and the stripping wire is disposed downstream from the second outlet end.

6. The fixing device of claim 5, wherein:

the support member is a second roll including the second surface; and at least one heating element is disposed inside of the second roll for heating the belt.

7. The fixing device of claim 5, wherein:

the support member is stationary and the belt engages the first surface and is rotated relative to the support member by rotation of the first roll; and the support member comprises a heater for heating the belt.

8. The fixing device of claim 5, wherein the stripping wire has a diameter of less than about 2 mm.

9. The fixing device of claim 8, wherein the stripping wire has a diameter of less than about 1 mm.

10. The fixing device of claim 5, wherein:

the belt is continuous and comprises a polymer forming the inner surface; and the stripping wire comprises a coating of a low-friction material effective to reduce wear of the inner surface of the belt during rotation of the belt.

11. The fixing device of claim 5, further comprising a tensioning device secured to the stripping wire, the tensioning device providing adjustment of the tension in the stripping wire to limit deflection of the stripping wire toward the second surface of the support member and maintain a portion of the belt spaced from the second surface.

12. The fixing device of claim 11, wherein the tensioning device comprises a first element secured to the stripping wire at a first location outward from a first edge of the belt, and a second member secured to the stripping wire at a second location outward from a second edge of the belt opposite to the first edge, at least one of the first element and second element being movable relative to the support member to adjust the tension in the stripping wire.

13. A method of stripping media from a surface in an apparatus useful in printing, comprising:

feeding a medium having marking material thereon to a nip, the nip being formed by a first surface of a first member and an outer surface of a belt rotatably supported on a second surface of a second member, the medium contacting the first surface and the outer surface of the belt at the nip;

contacting the inner surface of the belt with a tensioned stripping wire located between the second surface and the inner surface and spaced from the second surface; and stripping the medium from the outer surface of the belt after the medium passes through the nip, the stripping wire producing a sufficiently-high stripping force to facilitate the stripping of the medium from the outer surface of the belt, wherein the nip includes a first nip and a second nip, the first nip being formed by contact between (i) the inner surface of the belt and the second surface of the second member and (ii) the outer surface of the belt and the first surface of the first member, the first nip extends from an inlet end at which the medium enters the first nip to a first outlet end downstream from the inlet end at which the medium exits from the first nip;

the belt separates from the second surface at the first outlet end of the first nip;

the second nip is formed by contact between the outer surface of the belt and the first surface of the first member, the second nip extends from about the first outlet end of the first nip to a second outlet end downstream from the first outlet end, the inner surface of the belt being spaced from the second surface at the second nip; and the stripping wire is located downstream from the second outlet end of the second nip.

14. The method of claim 13, wherein:

the first member is a first roll including the first surface;

the second member is a second roll including the second surface; and the belt is heated by at least one heating element disposed inside of the second roll.

15. The method of claim 13, wherein:

the second member is stationary and the belt engages the first surface and is rotated relative to the second member by rotation of the first roll; and the second member comprises a heater contacting the inner surface of the belt.

16. The method of claim 13, wherein the stripping wire has a diameter of less than about 2 mm.

17. The method of claim 13, wherein:

the belt is continuous and comprises a polymer forming the inner surface of the belt; and the stripping wire comprises a coating of a low-friction material which reduces wear of the inner surface of the belt during rotation of the belt.

18. The method of claim 13, further comprising adjusting an amount of tension in the stripping wire to limit deflection of the stripping wire toward the second member.

* * * * *